US010150933B2

(12) United States Patent
Fedor et al.

(10) Patent No.: US 10,150,933 B2
(45) Date of Patent: Dec. 11, 2018

(54) PROCESS FOR REMOVING METAL FROM A METAL-CONTAINING GLYCERIDE OIL COMPRISING A BASIC QUATERNARY AMMONIUM SALT TREATMENT

(71) Applicant: EVONIK DEGUSSA GMBH, Essen (DE)

(72) Inventors: Gabriela Fedor, Frankfurt (DE); Martin Philip Atkins, Surrey (GB); Peter Goodrich, Craigavon (GB); Christopher Klatt Hamer, London (GB); Daniel Witthaut, Langenselbold (DE); Ulrich Boes, Frankfurt a.M. (DE)

(73) Assignee: Evonik Degussa GmbH, Essen (DE)

( * ) Notice: Subject to any disclaimer, the term of this patent is extended or adjusted under 35 U.S.C. 154(b) by 0 days.

(21) Appl. No.: 15/576,700

(22) PCT Filed: May 27, 2016

(86) PCT No.: PCT/EP2016/061965

§ 371 (c)(1),
(2) Date: Nov. 22, 2017

(87) PCT Pub. No.: WO2016/189115

PCT Pub. Date: Dec. 1, 2016

(65) Prior Publication Data

US 2018/0134988 A1 May 17, 2018

(30) Foreign Application Priority Data

May 27, 2015 (EP) ..... 15169317

(51) Int. Cl.

| | |
|---|---|
| ***C11B 3/06*** | (2006.01) |
| ***C11B 3/00*** | (2006.01) |
| ***C11B 3/02*** | (2006.01) |
| ***C11B 3/04*** | (2006.01) |
| ***C11B 3/14*** | (2006.01) |

(52) U.S. Cl.

CPC ..... *C11B 3/06* (2013.01); *C11B 3/001* (2013.01); *C11B 3/006* (2013.01); *C11B 3/02* (2013.01); *C11B 3/04* (2013.01); *C11B 3/14* (2013.01)

(58) Field of Classification Search

CPC ... C11B 3/06; C11B 3/001; C11B 3/04; C11B 3/014

See application file for complete search history.

(56) References Cited

U.S. PATENT DOCUMENTS

| | | | |
|---|---|---|---|
| 2,769,827 | A | 11/1956 | Clayton |
| 2,771,480 | A | 11/1956 | Chasanov et al. |
| 3,634,475 | A | 1/1972 | Beal et al. |
| 4,199,440 | A | 4/1980 | Verachtert |
| 4,533,501 | A | 8/1985 | Sen Gupta et al. |
| 4,629,588 | A | 12/1986 | Welsh et al. |
| 4,915,876 | A | 4/1990 | Lindsay |
| 4,959,158 | A | 9/1990 | Meikrantz |
| 5,243,059 | A | 9/1993 | Ibuki et al. |
| 5,362,893 | A | 11/1994 | Muylle et al. |
| 5,571,070 | A | 11/1996 | Meikrantz et al. |
| 5,591,340 | A | 1/1997 | Meikrantz et al. |
| 5,762,800 | A | 6/1998 | Meikrantz et al. |
| 6,395,948 | B1 | 5/2002 | Hope et al. |
| 6,407,271 | B1 | 6/2002 | Deffense |
| 6,464,859 | B1 | 10/2002 | Duncum et al. |
| 6,638,551 | B1 | 10/2003 | Levy et al. |
| 7,638,636 | B2 | 12/2009 | Zhou et al. |
| 8,609,572 | B2 | 12/2013 | Earl et al. |
| 8,653,288 | B2 | 2/2014 | Bertoli et al. |
| 8,664,460 | B2 | 3/2014 | Earle et al. |
| 9,115,333 | B2 | 8/2015 | Kase et al. |
| 9,217,120 | B2 | 12/2015 | Bhaggan et al. |
| 9,969,952 | B2 | 5/2018 | Norn et al. |
| 2001/0005759 | A1 | 6/2001 | Bertholet |
| 2002/0169071 | A1 | 11/2002 | Sauvage et al. |
| 2002/0198100 | A1 | 12/2002 | Mehnert et al. |

(Continued)

FOREIGN PATENT DOCUMENTS

| | | |
|---|---|---|
| CN | 102031202 | 4/2011 |
| CN | 106281672 | 1/2017 |

(Continued)

OTHER PUBLICATIONS

International Search Report for PCT/EP2016/061965 filed May 27, 2016.

(Continued)

*Primary Examiner* — Yate' K Cutliff

(74) *Attorney, Agent, or Firm* — Law Office of: Michael A. Sanzo, LLC

(57) ABSTRACT

The present invention relates to a process for removing metal from metal-containing glyceride oil comprising the steps of:

(i) contacting a glyceride oil, comprising chromium, manganese, iron, cobalt, nickel and/or copper in a total amount of from 10 mg/kg to 10,000 mg/kg, with a liquid comprising a basic quaternary ammonium salt to form a treated glyceride oil; wherein the basic quaternary ammonium salt comprises a basic anion selected from hydroxide, alkoxide, alkylcarbonate, hydrogen carbonate, carbonate, serinate, prolinate, histidinate, threoninate, valinate, asparaginate, taurinate and lysinate; and (ii) separating the treated glyceride oil from a salt comprising the quaternary ammonium cation, providing a treated glyceride oil containing a reduced amount of metals.

35 Claims, No Drawings

(56) References Cited

U.S. PATENT DOCUMENTS

| | | | |
|---|---|---|---|
| 2003/0085156 | A1 | 5/2003 | Schoonover |
| 2005/0010076 | A1 | 1/2005 | Wassereheid et al. |
| 2006/0070919 | A1 | 4/2006 | Valle et al. |
| 2006/0128996 | A1 | 6/2006 | Vaultier et al. |
| 2007/0142685 | A1 | 6/2007 | Elomari et al. |
| 2008/0251759 | A1 | 10/2008 | Kalb et al. |
| 2008/0306319 | A1 | 12/2008 | Earle et al. |
| 2009/0326228 | A1 | 12/2009 | Vaultier et al. |
| 2010/0187481 | A1 | 7/2010 | Bodesheim et al. |
| 2010/0324318 | A1 | 12/2010 | Prakash et al. |
| 2011/0027431 | A1 | 2/2011 | Fan |
| 2011/0146135 | A1 | 6/2011 | Brandvold |
| 2011/0207953 | A1 | 8/2011 | Corley et al. |
| 2012/0132564 | A1 | 5/2012 | Hardacre et al. |
| 2013/0323394 | A1 | 12/2013 | Bruse et al. |
| 2014/0018560 | A1 | 1/2014 | Sandoz et al. |
| 2014/0091008 | A1 | 4/2014 | Hardacre et al. |
| 2014/0121397 | A1 | 5/2014 | Kase et al. |
| 2016/0201010 | A1 | 7/2016 | Berry et al. |
| 2017/0022447 | A1 | 1/2017 | Atkins |
| 2017/0107449 | A1 | 4/2017 | Hruschka et al. |
| 2018/0057771 | A1 | 3/2018 | Sutterlin et al. |
| 2018/0134987 | A1 | 5/2018 | Fedor et al. |
| 2018/0148665 | A1 | 5/2018 | Goodrich |

FOREIGN PATENT DOCUMENTS

| | | | | |
|---|---|---|---|---|
| DE | 19638459 | | 3/1998 | |
| DE | 102013010035 | | 12/2014 | |
| EP | 0 791 643 | | 8/1997 | |
| EP | 1 911 829 | | 4/2008 | |
| EP | 1911829 | * | 4/2008 | ..... C10G 21/27 |
| EP | 2 502 500 | | 9/2012 | |
| FR | 2 861 084 | | 4/2005 | |
| GB | 499 678 | | 1/1939 | |
| GB | 708831 | | 5/1954 | |
| GB | 764833 | | 1/1957 | |
| GB | 912 623 | | 12/1962 | |
| GB | 1 520 523 | | 9/1978 | |
| GB | 2 068 404 | | 8/1981 | |
| JP | 2000202299 | | 1/1999 | |
| JP | 2006160969 | | 6/2006 | |
| JP | 2013250186 | | 12/2013 | |
| WO | WO 94/21765 | | 9/1994 | |
| WO | WO 99/12650 | | 3/1999 | |
| WO | WO 00/29120 | | 5/2000 | |
| WO | WO 00/68236 | | 11/2000 | |
| WO | WO 2007/101397 | | 9/2007 | |
| WO | WO 2007/138307 | | 12/2007 | |
| WO | WO 2010/063450 | | 6/2010 | |
| WO | WO 2010/136783 | | 12/2010 | |
| WO | WO 2011/005081 | | 1/2011 | |
| WO | WO 2011/009841 | | 1/2011 | |
| WO | WO 2011/009843 | | 1/2011 | |
| WO | WO 2011/069028 | | 6/2011 | |
| WO | WO 2012/004810 | | 1/2012 | |
| WO | WO 2012/031176 | | 3/2012 | |
| WO | WO 2012/069632 | | 5/2012 | |
| WO | WO 2012/069832 | | 5/2012 | |
| WO | WO 2012/130747 | | 10/2012 | |
| WO | WO 2012/169718 | | 12/2012 | |
| WO | WO 2014/012548 | | 1/2014 | |
| WO | WO 2014/042937 | | 3/2014 | |
| WO | WO 2015/000637 | | 1/2015 | |
| WO | WO 2016/005769 | | 1/2016 | |
| WO | WO 2016/189330 | | 12/2016 | |
| WO | WO 2016/189333 | | 12/2016 | |

OTHER PUBLICATIONS

Written Opinion of the International Search Authority for PCT/EP2016/061965 filed May 27, 2016.

International Preliminary Report on Patentability for PCT/EP2016/061965 filed May 27, 2016.

European Search Report for EP 15 16 9317.3 filed May 27, 2015.

European Search Opinion for EP 15 16 9317.3 filed May 27, 2015.

International Search Report for PCT/EP2016/061964 filed May 27, 2016 for copending U.S. Appl. No. 15/576,697.

Written Opinion of the International Search Authority for PCT/EP2016/061964 filed May 27, 2016 for copending U.S. Appl. No. 15/576,697.

International Preliminary Report on Patentability for PCT/EP2016/061964 filed May 27, 2016 for copending U.S. Appl. No. 15/576,697.

European Search Report for EP 15 16 9311.6 filed May 27, 2015 for copending U.S. Appl. No. 15/576,700.

European Search Opinion for EP 15 16 9311.6 filed May 27, 2015 for copending U.S. Appl. No. 15/576,700.

Andres, et al., "Toxicology, occurence and risk characterisation of the chloropropanols in food: 2-Monochloro-1,3-propanediol, 1,3-dichloro-2-propanol and 2,3-dichloro-1-propanol," *Food Chem Toxicol 58*: 467-478 (Aug. 2013).

Destaillats, "Glycidyl esters in refined palm (*Elaeis guineensis*) oil and related fractions. Part I: Formation mechanisms," *Food Chem 131(4)*:1391-1398 (Apr. 2012).

Destaillats, et al., "Formation mechanisms of Monochloropropanediol (MCPD) fatty acid diesters in refined palm (*Elaeisguineensis*) oil and related fractions," *Food Addit Contam 29(1)*: 29-37 (2012).

Fauzi, et al., "Trace metals content (contaminants) as initial indicator in the quality of heat treated palm oil whole extract," *IJEE 2(4)*: 671-676 (Jul. 2011).

Matthäus, "Organic or not organic—that is the question: How the knowledge about the orgin of chlorinated compounds can help to reduce formation of 3-MCPD esters," *Eur. J. Lipid Technol. 114*: 1333-1334 (2012).

Matthäus, et al., "Strategies for the reduction of 3-MCPD esters and related compounds in vegetable oils," *Eur. J. Lipid Technol. 113(3)*: 380-386 (Mar. 2011).

Nagy, et al., "Mass-defect filtering of isotope signatures to reveal the source of chlorinated palm oil contaminants," *Food Addit. Contam. 28(11)*: 1492-1500 (2011).

Nockemann, et al., "Task-Specific Ionic Liquid for Solubilizing Metal Oxides," *J. Phys. Chem. 110(42)*: 20978-20992 (Oct. 2006).

Pudel, et al., "On the necessity of edible oil refining and possible sources of 3-MCPD and glycidyl esters," *Eur. J. Lipid Technol. 113(3)*: 368-373 (Mar. 2011).

Strijowski, et al., "Removal of 3-MCPD esters and related substances after refining by adsorbent material," *Eur. J. Lipid Technol. 113(3)*: 387-392 (Mar. 2011).

Zhao, et al., "Review: Use of ionic liquids as 'green' solvents for extractions," *J. Chem. Technol. Biotechnol. 80*: 1089-1096 (published online May 2005).

U.S. Appl. No. 15/576,697, filed Nov. 22, 2017, Fedor.

El-Salam, et al., "Deacidification of High-acid Olive Oil," *J. Food Process Technol. S5*:1-7 (2011).

Ishiguro, et al., "Structure, solvation, and acid-base property in ionic liquids," *Pure Appl. Chem. 82*(10):1927-1941 (Aug. 2010).

Rodrigues, et al., "Deacidification of Vegetable Oils by Solvent Extraction," *Recent Patents on Engineering 1*:95-102 (2007).

Office Action dated Apr. 2, 2018 for copending U.S. Appl. No. 15/576,697.

Abelló, et al., "Supported choline hydroxide (ionic liquid) as heterogeneous catalyst for aldol condensation reactions," *Chem. Comm*. 1096-1097 (2004).

Alcade, et al., "A Simple Halide-to-Anion Exchange Method for Heteroaromatic Salts and Ionic Liquids," *Molecules 17*:4007-4027 (2012).

Cole, et al., "Novel Brønsted Acidic Ionic Liquids and Their Use as Dual Solvent—Catalysts," *J. Am. Chem. Soc. 124*:5962-5963 (2002).

Dijkstra, et al., "Determination of Trace Elements in Oils by Plasma Emission Spectroscopy," *JACOS 59*(4):199-204 (Apr. 1982).

Haines, et al., "Direct Determination of MCPD Fatty Acid Esters and Glycidyl Fatty Acid Esters in Vegetable Oils by LC-TOFMS," *J. Am. Oil Chem. Soc. 88*:1-14 (2011).

Manic, et al., "Extraction of Free Fatty Acids from Soybean Oil Using Ionic Liquids or Poly(ethyleneglycol)s," *AIChE 57*(5):1344-1355 (May 2011).

(56) References Cited

OTHER PUBLICATIONS

Smiglak, et al., "New hydrogen carbonate precursors for efficient and byproduct-free synthesis of ionic liquids based on 1,2,3,-tirmethylimidazolium and N,N-dimethylpyrrolidinium cores," *Green Chem. 12*:491-501 (2010).
Szydlowska-Czerniak, et al., "Spectroscopic Determination of Metals in Palm Oils from Different Stages of the Technological Process," *J. Agric. Food Chem. 61*:2276-2283 (2013).
Weisshaar, et al., "Determination of total 3-chloropropane-1,2-diol (3-MCPD) in edible oils by cleavage of MCPD esters with sodium methoxide," *Eur. J. Lipid Sci. Technol. 110*:183-186 (2008).
Response to Office Action dated Apr. 2, 2018 for copending U.S. Appl. No. 15/576,697, filed Jul. 27, 2018.
Notice of Allowance for copending U.S. Appl. No. 15/576,697, dated Oct. 12, 2018.

* cited by examiner

PROCESS FOR REMOVING METAL FROM A METAL-CONTAINING GLYCERIDE OIL COMPRISING A BASIC QUATERNARY AMMONIUM SALT TREATMENT

CROSS REFERENCE TO RELATED APPLICATIONS

The present application is US national stage of international application PCT/EP2016/061965, which had an international filing date of May 27, 2016 and which was published in English under PCT Article 21(2) on Dec. 1, 2016. Priority is claimed to European application EP 15169317.3, filed on May 27, 2015.

The present invention relates to a process for removing metal from metal-containing glyceride oil, and the integration of this process into refining a glyceride oil. The present invention also relates to the use of contacting a glyceride oil with a basic quaternary ammonium salt for reducing the metal content of the glyceride oil.

There are a plethora of glyceride oils that may be extracted from natural sources for human or animal consumption, or for other domestic and commercial uses, including the production of bio-diesel. Such glyceride oils include, for example, vegetable oils, marine oils and animal fats and oils. Typically, it is necessary for glyceride oils to undergo refining before their use, which can vary depending on the particular oil and the associated level and nature of any contamination following extraction.

Palm oil, for instance, is a vegetable oil derived primarily from the fruit of oil palms and is composed of a number of fatty acids, including palmitic and oleic acids, which are esterified with glycerol. Palm oil has numerous applications and is commonly associated with use in bio-diesel as well as food preparation or as a food additive, whilst it has also found use as an additive in cosmetics and cleaning products. Crude palm oil is known to contain vitamin E and is also one of the richest natural plant sources of carotenes, associated with pro-vitamin A activities, which has seen palm oil also used as a source of antioxidants.

Palm oil contains a large amount of highly saturated fats, has a high oxidative stability and is naturally low in cholesterol and, partly due to its low cost, is used increasingly in the food industry as a substitute for trans-unsaturated fats in certain processed food products. However, as with other glyceride oils, in order to be rendered edible crude palm oil must undergo a refining process to remove unwanted components. Crude palm oil comprises mono-, di- and triglycerides, carotenes, sterols, as well as free fatty acids (FFA), which are not esterified with glycerol. FFA leads to degradation of the oil and an increase in rancidity and is thus one of a number of components that the refining process seeks to remove.

Other contaminants of palm oil that the refining process seeks to remove are contaminant metals. One of the most common metal contaminants of crude glyceride oil is iron, which is thought to derive from the machinery and tanks used in its processing and storage. Iron [III] chloride is also used as a coagulant in water treatments which can also be absorbed during plant development. It is also known for crude glyceride oil to have appreciable quantities of sodium, potassium, calcium, magnesium, chromium, nickel and aluminium metals. As far as vegetable oils are concerned, potassium, calcium and magnesium are known to be the most abundant metal constituents in plant material.

The metal content of glyceride oil can have a significant impact upon its organoleptic properties and its storage stability. For instance, metal contaminants, particularly iron, can cause darkening of the oil during deodorisation and even small amounts of iron can significantly reduce oil stability (International Journal of Energy and Environment (IJEE), 2011, 2, 671-676). Iron, copper, cobalt, nickel and manganese have all been reported to have pro-oxidant properties and contribute to oxidative deterioration of glyceride oil. Meanwhile, metals such as mercury, lead, cadmium and chromium are known for their toxicities.

It is well known that glyceride oil can also be used for the production of biodiesel using a transesterification process whereby triglyceride components of the oil are converted into Fatty Acid Methyl Esters (FAME) by contact with an alcohol in the presence of a transesterification catalyst. Metal contaminants in the oil can have a detrimental effect on the performance of the transesterification catalyst and it is typically necessary to reduce the concentration of transition metal ions in the oil to less than 1 mg/kg prior to use in biodiesel production processes.

Consequently, there has been increasing interest in removing metal ion contaminants of glyceride oil for food and biodiesel applications alike.

As part of a typical refining process, crude glyceride oil undergoes degumming through water washing and/or treatment with aqueous phosphoric acid and/or aqueous citric acid. Water washing removes hydratable phosphatides whilst the acid treatment is used to remove non-hydratable phospholipid components. The degumming step removes sources of phosphorus as a result of removing phospholipid components. Degumming may also simultaneously remove metal ions from the oil which form salts of phosphatidic acid in the non-hydratable phosphatides. Refining of edible oil also typically includes bleaching with bleaching earth or clay to reduce the content of colour bodies, including chlorophyll, residual soap and gums, and oxidation products. The bleaching process is also capable of absorbing and extracting trace metals. However, both degumming and bleaching may not be capable of reducing the content of metal contaminants sufficiently for all purposes.

U.S. Pat. No. 6,407,271 describes a process for removing phospholipids and/or polyvalent metals from vegetable oil by emulsifying the oil with an aqueous solution of a salt of a polycarboxylic acid, preferably tetrasodium EDTA, to form a fine suspension of micelles, followed by centrifuging or ultrafiltration. The EDTA salt is said to chelate metallic polyvalent cations (e.g. Fe(II), Fe(III), Ca(II) and Mg (II)) to form complexes which are more stable than the salts of the metal cations and phosphatidic acid or phosphoric or citric acids used in degumming.

WO1994/021765 describes a process for simultaneously neutralising FFA in glyceride oils and removing contaminants including trace metals. The oil is contacted with a solid alkali metal silicate, such as sodium metasilicate pentahydrate and hydrous sodium polysilicate, before heating and filtering.

WO 2012/004810 discloses a process for removing metals in oils and fats by treating with clay followed by an ion exchange resin. This process relies on both adsorbant and resin materials which increases both materials and equipment costs associated with the refining process, particularly if regeneration steps are integrated into the process in order to recycle clay and/or ion exchange resin.

Liquid-liquid extraction techniques with polar solvents have previously been disclosed as oil treatments for glyceride oils, for instance for the removal of FFA, operating on the basis of the solubility differences of the contaminant and the oil effecting separation by selective partitioning into a particular solvent phase. Meirelles et al., Recent Patents on Engineering 2007, 1, 95-102, gives an overview of such approaches to the deacidification of vegetable oils. Liquid-liquid extraction methods are generally considered to be advantageous on the basis that they may be performed at room temperature, they do not generate waste products and they benefit from low neutral oil losses. However, Meirelles et al. observe that there are significant capital costs associated with the implementation of a liquid-liquid extraction process and there remain doubts as to the overall benefits. Moreover, the polar solvents used in these liquid-liquid extraction techniques are often capable of also removing mono- and di-glycerides from the oil in addition to FFA, which may not be desirable.

Ionic liquids have received some attention as potential solvents for extractions. J. Chem. Tecnol. Biotechnol. 2005, 80, 1089-1096 gives an overview of recent applications of ionic liquids as solvents in extractions of a variety of substances, including metal ions. However, the metal ion extractions are limited to cases where metal ions are extracted from an aqueous phase into an immiscible ionic liquid phase, as opposed to extraction from an oil phase. It is reported that extraction can incorporate the use of an extractant/ligand/metal chelator dissolved in the ionic liquid phase. More recently, task specific ionic liquids ("TSILs") have been developed which incorporate a metal ligating functional group. For example, it is suggested that TSILs containing side-chains of thiourea and urea derivatives could dramatically increase partitioning of $Hg^{2+}$ and $Cd^{2+}$ from an aqueous phase.

J. Phys. Chem. B 2006, 110, 20978-20992 describes certain TSILs based on protonated betaine bis(trifluoromethylsulfonyl)imide for use in solubilising metal oxides. A typical experiment is described in which metal oxide is dissolved in a mixture of betainium bis(trifluoromethylsulfonyl)imide and water. The presence of water is said to facilitate dissolution of the metal oxide in the ionic liquid. This form of extraction corresponds to selective partitioning of metal oxide into a distinct ionic liquid phase from an aqueous phase. It is said that dissolution of the metal oxide in the ionic liquid phase forms a metal complex of protonated betaine bis(trifluoromethylsulfonyl)imide which may subsequently be decomposed by treatment with an aqueous acid in order to regenerate the ionic liquid. This treatment is only reported as being of use for extracting metal oxides and not other metal-containing compounds or free metal ions. Furthermore, there is no suggestion that the ionic liquid is suitable for extracting metal oxides from an oil phase.

An issue with the use of TSILs for extraction is that their use is limited based on the species which is to be extracted, the nature of the fluid phase from which extraction takes place and the potential for unwanted interactions with other species present in the fluid phase, particularly those which have labile functional groups. The phase behaviour of betainium bis(trifluoromethylsulfonyl)imide described above is also known to be both pH and temperature dependent. As a result, the ability of betainium bis(trifluoromethylsulfonyl)imide to complex metal oxide may be hampered by the presence of acidic species. Glyceride oil is known to have a varying content of FFA, depending on the extent of its refining, which may have significant impact on the proton activity of the oil. This may also affect the ability for metals to be extracted the oil.

There remains a need for an alternative process for removing metals from glyceride oil which can be integrated into conventional glyceride oil refining processes and capable of providing high value refined glyceride oil products, whilst maximising energy savings associated with refining.

The present invention is based on the surprising discovery that basic quaternary ammonium salts comprising a basic anion can be advantageously utilised for extracting metals from glyceride oil, which treatment can also be readily integrated into a glyceride refining process. Basic quaternary ammonium salts are particularly useful for extracting chromium, manganese, iron, cobalt, nickel and copper and are therefore useful for preventing oxidative degradation of a glyceride oil promoted by impurities of these metals.

In addition, treatment of glyceride oil with a liquid comprising the basic quaternary ammonium salt has been found to at least partially remove pigments and odiferous compounds which are typically removed in a separate bleaching step and a high temperature (for example, 240° C. to 270° C.) deodorization step respectively during conventional refining processes. Treatment with a liquid comprising the quaternary ammonium salt has also been found to at least partially degum glyceride oil. Treatment of glyceride oil with a liquid comprising the basic quaternary ammonium salt also allows for using lower temperatures and/or shorter time periods in a subsequent deodorization step. This has the advantage of reducing energy requirements and materials costs associated with a refining process comprising a step of metal removal with a basic quaternary ammonium salt.

Thus, in a first aspect, the present invention provides a process for removing metal from a metal-containing glyceride oil comprising the steps of:

(i) contacting a glyceride oil, comprising at least one metal from the group consisting of chromium, manganese, iron, cobalt, nickel and copper, with a liquid comprising a basic quaternary ammonium salt to form a treated glyceride oil; wherein said glyceride oil contains said metals in a total amount of from 10 mg/kg to 10,000 mg/kg, and wherein the basic quaternary ammonium salt comprises a basic anion selected from hydroxide, alkoxide, alkylcarbonate, hydrogen carbonate, carbonate, serinate, prolinate, histidinate, threoninate, valinate, asparaginate, taurinate and lysinate; and a quaternary ammonium cation; and (ii) separating the treated glyceride oil from a salt comprising the quaternary ammonium cation after contacting the glyceride oil with the quaternary ammonium salt, providing a treated glyceride oil containing a reduced amount of said metals compared to the glyceride oil contacted in step (i).

The total concentration of the specified metals in the glyceride oil prior to contact in step (i) is preferably from 50 mg/kg to 5,000 mg/kg, more preferably 100 mg/kg to 2,000 mg/kg.

The basic quaternary ammonium salt treatment according to the process of the present invention may be suitably applied to crude metal-containing glyceride oil which has not undergone any previous refining steps. Alternatively, the above process may be applied to metal-containing glyceride oil which has undergone one or more additional refining steps prior to treatment with the basic quaternary ammonium salt.

The treatment with basic quaternary ammonium salt can therefore be integrated into a glyceride oil refining process at several stages. For instance, the treatment can be implemented at a stage which precedes exposure to high temperatures so as to reduce the amount of metal contaminants, particularly iron, that would otherwise lead to darkening of the glyceride oil and negatively impact upon organoleptic properties. Alternatively, the treatment can be implemented towards the end of the refining process as a means for reducing the level of metal contaminants after contact with metal vessels or machinery associated with processing where metal leaching into the oil, particularly at high temperature, may be likely. This flexibility makes the treatment with basic quaternary ammonium salt in accordance with the present invention particularly attractive for integrating into pre-existing refining processes and systems.

Thus, in another aspect, the process of the present invention preferably comprises an additional step of:

(iii) subjecting the treated glyceride oil after the separation step (ii) to at least one further refining step.

The term "glyceride oil" used herein refers to an oil or fat which comprises triglycerides as the major component thereof. For example, the triglyceride component may be at least 50 wt. % of the glyceride oil. The glyceride oil may also include mono- and/or di-glycerides. Preferably, the glyceride oil is at least partially obtained from a natural source (for example, a plant, animal or fish/crustacean source) and is also preferably edible. Glyceride oils include vegetable oils, marine oils and animal oils/fats which typically also include phospholipid components in their crude form.

Vegetable oils include all plant, nut and seed oils. Examples of suitable vegetable oils which may be of use in the present invention include: acai oil, almond oil, beech oil, cashew oil, coconut oil, colza oil, corn oil, cottonseed oil, grapefruit seed oil, grape seed oil, hazelnut oil, hemp oil, lemon oil, macadamia oil, mustard oil, olive oil, orange oil, palm oil, peanut oil, pecan oil, pine nut oil, pistachio oil, poppyseed oil, rapeseed oil, rice bran oil, safflower oil, sesame oil, soybean oil, sunflower oil, walnut oil and wheat germ oil. Preferred, vegetable oils are those selected from coconut oil, corn oil, cottonseed oil, groundnut oil, olive oil, palm oil, rapeseed oil, rice bran oil, safflower oil, soybean oil and sunflower oil. Most preferably, the vegetable oil is palm oil.

Suitable marine oils include oils derived from the tissues of oily fish or crustaceans (e.g. krill) and oils derived from algae. Examples of suitable animal oils/fats include pig fat (lard), duck fat, goose fat, tallow oil, and butter.

FFA which may be present in the glyceride oils include monounsaturated, polyunsaturated and saturated FFA. Examples of unsaturated FFA include: myristoleic acid, palmitoleic acid, sapienic acid, oleic acid, elaidic acid, vaccenic acid, linoleic acid, linoelaidic acid, α-linolenic acid, arachidonic acid, eicosapentaenoic acid, erucic acid and docosahexaenoic acid. Examples of saturated FFA include: caprylic acid, capric acid, undecylic acid, lauric acid, tridecylic acid, myristic acid, palmitic acid, margaric acid, stearic acid, nonadecylic acid, arachidic acid, heneicosylic acid, behenic acid, lignoceric acid and cerotic acid.

Preferably the glyceride oil used in the present invention is a vegetable oil. More preferably, the glyceride oil is a vegetable oil selected from coconut oil, corn oil, cottonseed oil, groundnut oil, olive oil, palm oil, rapeseed oil, rice bran oil, safflower oil, soybean oil and sunflower oil. Most preferably, the vegetable oil is palm oil.

The term "palm oil" used herein includes an oil at least partially derived from a tree of genus *Elaeis*, forming part of the *Arecaceae* genera, and including the species *Elaeis guineensis* (African oil palm) and *Elaeis oleifera* (American oil palm), or hybrids thereof. Reference to palm oil herein therefore also includes palm kernel oil. The palm oil which is treated in accordance with the process of the invention may be crude or non-crude (i.e. at least partially refined). As such, reference to palm oil herein also includes fractionated palm oil, for example palm oil stearin or palm oil olein fractions.

The term "crude" used herein in reference to glyceride oil is intended to mean glyceride oil which has not undergone refining steps following oil extraction. For example, crude glyceride oil will not have undergone degumming, deacidification, winterisation, bleaching, depigmentation or deodorization. "Refined" used herein in reference to glyceride oil is intended to mean a glyceride oil which has undergone one or more refining steps, such as degumming, deacidification, winterisation, bleaching, depigmentation and/or deodorization.

The term "metal" used herein in reference to the metal-containing glyceride oil is intended to refer to metal-containing compounds or complexes, as well as free metal ions. Metal-containing compounds include metal salts, metal oxides or metal sulphides and the like, whilst metal complexes include, for example, coordination complexes.

The process of the invention may remove further metals in addition to chromium, manganese, iron, cobalt, nickel and copper, which metals may include alkali metals (such as sodium and potassium) alkaline earth metals (such as magnesium and calcium) additional transition metals (such as zinc, cadmium and mercury) and post-transition metals (such as aluminium, tin and lead).

Where reference is made herein to a "salt comprising the quaternary ammonium cation" in step (ii), it is intended to refer to a salt which derives from the quaternary ammonium salt contacted in step (i), at least by virtue of the quaternary ammonium cation present in the salt separated in step (ii). In some examples, the glyceride oil contains FFA and the salt comprising the quaternary ammonium cation also comprises an anion of a fatty acid. In further examples, the salt comprising the quaternary ammonium cation comprises the same anion as the quaternary ammonium salt contacted in step (i), in other words the salt separated in step (ii) is the same as the salt contacted in step (i).

The term "quaternary ammonium cation" used herein is intended to refer to a cation containing at least one nitrogen atom carrying a positive electric charge, which nitrogen atom is bonded only to carbon atoms. The nitrogen atom may be saturated, being bonded to four carbon atoms by single bonds, or may be unsaturated, being bonded to two carbon atoms by single bonds and to a third carbon atom by a double bond. Where the nitrogen atom is unsaturated, it may be part of a heteroaromatic ring, such as an imidazolium cation. Where the nitrogen atom is saturated, it may be part of an alicyclic ring, such as a pyrrolidinium or a piperidinium cation. Preferably, the nitrogen atom is bonded to four substituted or unsubstituted $C_1$ to $C_{12}$ hydrocarbyl groups, which may carry additional substituents at carbon atoms that are not bonded to the nitrogen atom carrying a positive electric charge. The term "hydrocarbyl group" refers to a univalent radical derived from a hydrocarbon and may include alkyl, cycloalkyl, alkenyl, alkynyl, or aryl groups.

The quaternary ammonium salt referred to herein is provided in the form of a liquid comprising the salt. The quaternary ammonium salt is non-volatile and exists only in its ionic form as part of the liquid. The liquid may be a solution of the salt in a suitable solvent. Suitable solvents include polar solvents such as aqueous or alcohol solvents, for example water, methanol or ethanol, or mixtures thereof. Preferably, the solvent is water. The quaternary ammonium salt may be an ionic liquid in which case the liquid contacted in step (i) may consist essentially of the ionic liquid or comprise the ionic liquid and one or more co-solvents. Suitable co-solvents include polar solvents such as aqueous or alcohol co-solvents, for example water, methanol, ethanol, or mixtures thereof.

The term "ionic liquid" as used herein refers to a liquid that is capable of being produced by melting a salt, and when so produced consists solely of ions. An ionic liquid may be formed from a homogeneous substance comprising one species of cation and one species of anion, or it can be composed of more than one species of cation and/or more than one species of anion. Thus, an ionic liquid may be composed of more than one species of cation and one species of anion. An ionic liquid may further be composed of one species of cation, and one or more species of anion. Still further, an ionic liquid may be composed of more than one species of cation and more than one species of anion. The term "ionic liquid" includes compounds having both high melting points and compounds having low melting points, e.g. at or below room temperature. The ionic liquid preferably has a melting point of less than 200° C., more preferably less than 100° C. and most preferably less than 30° C.

Preferably, the quaternary ammonium cation of the quaternary ammonium salt used in contacting step (i) according to the present invention is selected from:

$[N(R^a)(R^b)(R^c)(R^d)]^+$, wherein $R^a$, $R^b$, $R^c$ and $R^d$ are each independently selected from $C_1$ to $C_8$ alkyl, wherein one or more of $R^a$, $R^b$, $R^c$ and $R^d$ may optionally be substituted at carbon atoms that are not bonded to the nitrogen atom by one to three groups selected from: $C_1$ to $C_4$ alkoxy, $C_2$ to $C_8$ alkoxyalkoxy, $C_3$ to $C_6$ cycloalkyl, —OH, —SH, —$CO_2R^e$, and —$OC(O)R^e$, where $R^e$ is $C_1$ to $C_6$ alkyl, for example by one to three —OH groups.

More preferably, the quaternary ammonium cation is selected from:

$[N(R^a)(R^b)(R^c)(R^d)]^+$, wherein $R^a$, $R^b$, $R^c$ and $R^d$ are each independently selected from $C_1$ to $C_4$ alkyl, including methyl, ethyl, n-propyl, isopropyl, n-butyl, sec-butyl, isobutyl and tert-butyl, wherein at least one of $R^a$, $R^b$, $R^c$ or $R^d$ is substituted each by a single —OH group. Substituted $R^a$, $R^b$, $R^c$ or $R^d$ are preferably 2-hydroxyethyl, 2-hydroxypropyl or 2 hydroxy-2-methylethyl.

Most preferably, the quaternary ammonium cation is choline: $(CH_3)_3N^+CH_2CH_2OH$.

The quaternary ammonium salt used in contacting step (i) of the process of the present invention also comprises a basic anion selected from hydroxide, alkoxide, alkylcarbonate, hydrogen carbonate, carbonate, serinate, prolinate, histidinate, threoninate, valinate, asparaginate, taurinate and lysinate.

In an embodiment of the present invention, the basic anion is selected from alkylcarbonate, hydrogen carbonate, carbonate, hydroxide and alkoxide; preferably hydrogen carbonate, alkylcarbonate and carbonate; and more preferably hydrogen carbonate.

Where the basic anion is selected from alkoxide or alkylcarbonate, the alkyl group may be linear or branched and may be substituted or unsubstituted. In one preferred embodiment, the alkyl group is unsubstituted. In another preferred embodiment, the alkyl group is unbranched. In a more preferred embodiment, the alkyl group is unsubstituted and unbranched. The alkyl group may comprise from 1 to 10 carbon atoms, preferably from 1 to 8 carbon atoms and more preferably form 1 to 4 carbon atoms. The alkyl group may thus be selected from methyl, ethyl, propyl, butyl, pentyl, hexyl, heptyl, octyl, nonyl and/or decyl. It will be understood that branched alkyl groups such as iso-propyl, isobutyl, sec-butyl and/or tert-butyl may also be used. Especially preferred are methyl, ethyl, propyl and butyl. In a further preferred embodiment, the alkyl group is selected from methyl and ethyl.

In an embodiment of the present invention, the basic anion is selected from serinate, prolinate, histidinate, threoninate, valinate, asparaginate, taurinate and lysinate, preferably from serinate, lysinate, prolinate, taurinate and threoninate, more preferably from lysinate, prolinate and serinate, most preferably the basic anion is lysinate.

It will be appreciated that in order for glyceride oil obtained directly from the process of the invention to be fit for consumption, the quaternary ammonium salt used for contacting the oil in step (i), as well as the salt comprising the quaternary ammonium cation separated in step (ii), should have little or no toxicity and/or be readily and substantially separable from the treated oil. A quaternary ammonium salt comprising a choline cation is particularly suitable for use with the process of the present invention. Choline is a water soluble essential nutrient grouped with the B-complex vitamins which is a precursor to acetylcholine, involved in numerous physiological functions. Choline has particularly low toxicity and excellent biodegradability, making it an ingredient known in nature that is capable of forming a quaternary ammonium cation which is particularly useful in the process of the present invention.

Thus, in particularly preferred embodiments of the present invention the quaternary ammonium salt is selected from choline bicarbonate: $(CH_3)_3N^+CH_2CH_2OH\ HOCOO^-$; choline alkylcarbonate: $(CH_3)_3N^+CH_2CH_2OH\ ROCOO^-$ where R is an alkyl group; or choline hydroxide: $(CH_3)_3N^+CH_2CH_2OH\ OH^-$.

Quaternary ammonium salts comprising a basic anion selected from serinate, prolinate, histidinate, threoninate, valinate, asparaginate, taurinate and lysinate are also particularly suitable in the process of the present invention due to the particularly low toxicity of these amino acid derivatives.

In the most preferred embodiments of the present invention, the quaternary ammonium salt is choline bicarbonate: $(CH_3)_3N^+CH_2CH_2OH\ HOCOO^-$.

The quaternary ammonium salt used in contacting step (i), as well as the salt comprising the quaternary ammonium cation separated in step (ii), preferably have low oil solubility and preferentially partition into a non-oil phase, such as an aqueous phase, facilitating their removal from the treated oil. More preferably, the quaternary ammonium salt is immiscible with the oil. By immiscible with the oil it is meant that a glyceride oil saturated with the quaternary ammonium salt contains less than 50 mg/kg, preferably less than 30 mg/kg, more preferably less than 20 mg/kg, most preferably, less than 10 mg/kg, for example, less than 5 mg/kg of quaternary ammonium salt.

The solubility of the quaternary ammonium salt may also be tailored such that the quaternary ammonium salt is either insoluble or soluble in water. By insoluble in water it is meant that the quaternary ammonium salt has a solubility in water of less than 50 mg/kg, preferably, less than 30 mg/kg, more preferably less than 20 mg/kg, most preferably, less than 10 mg/kg, for example, less than 5 mg/kg. Preferably, however, the quaternary ammonium salt is miscible with water.

In preferred embodiments, the quaternary ammonium cation is selected to provide low melting fatty acid salts with linear $C_{12}$ to $C_{18}$ fatty acids. Particularly preferred quaternary ammonium cations form salts with such fatty acids having melting points of less than 100° C. Such salts may be conveniently separated during separation step (ii) by liquid-liquid separation techniques discussed below.

Suitably, the contacting step (i) of the process of the present invention is carried out at a temperature of less than 80° C., preferably from 25 to 65° C., more preferably from 35 to 55° C., for example, 40° C. As will be appreciated, where the glyceride oil is semi-solid at room temperature, higher temperatures are preferable such that the glyceride oil is in a liquid form for contacting with the liquid comprising the quaternary ammonium salt. Suitably, the contacting step (i) is carried out at a pressure of from 0.1 MPa to 10 MPa (1 bar to 100 bar).

In some embodiments, the contacting step may be carried out by contacting glyceride oil with the liquid comprising the quaternary ammonium salt in a vessel wherein the resulting mixture is stirred using, for example, a mechanical stirrer, an ultrasonic stirrer, an electromagnetic stirrer or by bubbling an inert gas through the mixture. Alternatively, the contacting step may be carried out by passing a mixture of the glyceride oil and the liquid comprising the quaternary ammonium salt through a static mixer, such as a Sulzer mixer or a Kenics mixer.

Suitably, the liquid comprising the quaternary ammonium salt and the glyceride oil may be contacted in a volume ratio of from 1:40 to 1:300. The contacting step may last from 1 minute to 60 minutes, preferably 2 to 30 minutes, more preferably, 5 to 20 minutes and most preferably, 8 to 15 minutes.

FFA present in the oil may be neutralised upon contact with the quaternary ammonium salt to form a quaternary ammonium fatty acid salt. In preferred embodiments, the amount of quaternary ammonium salt employed in the contacting step is at least stoichiometric with the molar amount of FFA contained in the oil. Preferably, the molar ratio of the quaternary ammonium salt to FFA in the oil is from 1:1 to 10:1, more preferably from 1:1 to 2:1. The content of FFA in the glyceride oil may be determined prior to treatment with quaternary ammonium salt using common titration techniques, of which the person of skill in the art is aware. For instance, titration with sodium hydroxide using phenolphthalein indicator may be used to determine the FFA content of glyceride oil.

In the contacting step (i), a liquid comprising the quaternary ammonium salt is contacted with the glyceride oil. The liquid may comprise a suitable solvent or mixture of solvents as described hereinbefore which is/are compatible with the quaternary ammonium salt and the glyceride oil. A solvent or mixture of solvents may be used to modify the viscosity of the liquid comprising the quaternary ammonium salt as desired. Alternatively, use of a solvent may confer desirable properties on the liquid structure of the liquid based reaction that are particularly suitable for promoting the reaction of the quaternary ammonium salt. As mentioned above, suitable solvents for this purpose include polar solvents, such as water, or alcohols, for example methanol or ethanol.

In preferred embodiments, the liquid comprising the quaternary ammonium salt comprises a solvent, preferably wherein the concentration of quaternary ammonium salt in the liquid is 15 wt. % to 90 wt. %. Preferably the solvent is water, such as deionised water.

Where the basic anion of the quaternary ammonium salt is selected from alkylcarbonate, hydrogen carbonate and carbonate, especially where the basic anion is hydrogen carbonate, it is particularly preferred that the liquid comprising the quaternary ammonium salt comprises a solvent, preferably water, and the concentration of quaternary ammonium salt in the liquid is 50 wt. % to 90 wt. %, preferably from 75 wt. % to 85 wt. %.

Where the basic anion of the quaternary ammonium salt is selected from hydroxide and alkoxide, especially where the basic anion is hydroxide, it is particularly preferred that the liquid comprising the quaternary ammonium salt comprises a solvent, preferably water, and the concentration of quaternary ammonium salt in the liquid is 15 wt. % to 60 wt. %, preferably from 40 wt. % to 50 wt. %.

In the above embodiments where the liquid comprises a solvent, additional co-solvents may also be present. For instance, where water is the solvent, alcohol co-solvent(s) may also be present. In the above embodiments, the concentration of co-solvents in the liquid may, for example, be between 1 wt. % and 40 wt. % of the liquid, preferably between 1 wt. % and 10 wt. %.

Separation of the salt comprising the quaternary ammonium cation in step (ii) of the process, may be carried out by gravity separation (for example, in a settling unit), where the treated glyceride oil is generally the upper phase and the salt comprising the quaternary ammonium cation together with any solvent are incorporated in the lower phase in the settling unit. Separation of the salt comprising the quaternary ammonium cation may also be achieved using, for example, a decanter, a hydrocyclone, an electrostatic coalescer, a centrifuge or a membrane filter press. Preferably, the phases are separated using a centrifuge. Contacting and separation steps may be repeated several times, for example 2 to 4 times.

Where the salt comprising the quaternary ammonium cation separated in step (ii) is a solid which is precipitated after contacting step (i), for instance, following formation of a quaternary ammonium fatty acid salt, the solid salt may be separated from the oil by filtration or centrifugation. Alternatively, a polar solvent as described hereinbefore which is immiscible with the oil phase may be added to solubilise the solid salt, following which the salt-containing phase may be separated from the oil by the methods described above.

Contacting and separation steps may also be carried out together in a counter-current reaction column. The glyceride oil (hereinafter "oil feed stream") is generally introduced at or near the bottom of the counter-current reaction column and the liquid comprising the quaternary ammonium salt (hereinafter "quaternary ammonium salt feed stream") at or near the top of the counter-current reaction column. A treated oil phase (hereinafter "product oil stream") is withdrawn from the top of the column and a phase containing a salt comprising the quaternary ammonium cation and solvent when present (hereinafter "secondary stream") from at or near the bottom thereof. Preferably, the counter-current reaction column has a sump region for collecting the secondary stream. Preferably, the oil feed stream is introduced to the counter-current reaction column immediately above the sump region. More than one counter-current reaction column may be employed, for example 2 to 6, preferably 2 to 3 columns arranged in series. Preferably, the counter-current reaction column is packed with a structured or a random packing material, for example, glass Raschig rings, thereby increasing the phase boundary surface. Alternatively, the counter-current reaction column may contain a plurality of trays.

In particularly preferred embodiments, contacting and separating steps are carried out together in a centrifugal contact separator, for example, a centrifugal contact separator as described in U.S. Pat. Nos. 4,959,158, 5,571,070, 5,591,340, 5,762,800, WO 99/12650, and WO 00/29120. Suitable centrifugal contact separators include those supplied by Costner Industries Nevada, Inc. Glyceride oil and the liquid comprising the quaternary ammonium salt may be introduced into an annular mixing zone of the centrifugal contact separator. Preferably, the glyceride oil and the liquid comprising quaternary ammonium salt are introduced as separate feed streams into the annular mixing zone. The glyceride oil and the liquid comprising quaternary ammonium salt are rapidly mixed in the annular mixing zone. The resulting mixture is then passed to a separation zone wherein a centrifugal force is applied to the mixture to produce a clean separation of an oil phase and a secondary phase.

Preferably, a plurality of centrifugal contact separators are used in series, preferably, 2 to 6, for example 2 to 3. Preferably, the oil feed stream is introduced into the first centrifugal contact separator in the series while the liquid comprising the quaternary ammonium salt feed stream is introduced into the last centrifugal contact separator in the series such that oil of progressively decreasing content of, for instance, FFA or free chloride anions is passed from the first through to the last centrifugal contact separator in the series while a quaternary ammonium salt stream of progressively increasing content of, for instance, quaternary ammonium-FFA salt and/or quaternary ammonium chloride content is passed from the last through to the first centrifugal contact separator in the series. Thus, a phase containing a salt comprising the quaternary ammonium cation is removed from the first centrifugal contact separator and the treated oil phase is removed from the last centrifugal contact separator in the series.

If necessary, residual quaternary ammonium salt that is present in the treated glyceride may be recovered by passing the product oil stream through a silica column such that the residual quaternary ammonium salt is adsorbed onto the silica column. The adsorbed quaternary ammonium salt may then be washed off the silica column using a solvent for the quaternary ammonium salt and the quaternary ammonium salt may be recovered by driving off the solvent at reduced pressure.

The treated glyceride oil may also be passed through a coalescer filter for coalescing fine droplets of non-oil phase liquid, for instance liquid comprising a salt of the quaternary ammonium cation, so as to produce a continuous phase and facilitate phase separation. Preferably, the coalescer filter comprises a filter medium made from a material which is easier wetted by the liquid comprising the quaternary ammonium salt than by the glyceride oil, for example a filter medium made from glass fibers or cellulose.

In some embodiments, for example where the quaternary ammonium salt is an ionic liquid, the liquid comprising the quaternary ammonium salt may be provided on a support material. Suitable supports for use in the present invention may be selected from silica, alumina, alumina-silica, carbon, activated carbon or a zeolite. Preferably, the support is silica. The supported form may be provided for contact with the oil as a slurry comprising a suitable solvent, wherein the solvent is as described hereinbefore.

Where supported quaternary ammonium salts are used, contacting and separation steps may also be carried out together by passing the oil through a column packed with a supported quaternary ammonium salt (i.e. a packed bed arrangement). In addition, or alternatively, a fixed-bed arrangement having a plurality of plates and/or trays may be used.

Methods for supporting the quaternary ammonium salt on a support material are well known in the art, such as for example, in US 2002/0169071, US 2002/0198100 and US 2008/0306319. Typically, the quaternary ammonium salt may be physisorbed or chemisorbed on the support material, and preferably physisorbed. In the processes of the present invention, the quaternary ammonium salt may be adsorbed onto the support in a quaternary ammonium salt:support mass ratio of from 10:1 to 1:10, preferably in a quaternary ammonium salt:support mass ratio of from 1:2 to 2:1.

It has been found that treatment of the metal-containing glyceride oil with a liquid comprising the quaternary ammonium salt in accordance with the present invention is capable of reducing the metal content of the glyceride oil. Several reaction mechanisms are believed to be possible as a result of contacting the oil with a liquid comprising the quaternary ammonium salt, which are discussed in further detail below.

The metal content of glyceride oil is believed to derive from metal vessels and machinery used for extracting, processing and storing the glyceride oil, as well as from metal contaminants present in ecosystems, such as from fertilizers or contaminated soils, which can be absorbed by vegetation or otherwise enter the food chain. Metal containing enzymes and pigments of the organism producing the glyceride oil and their degradation products formed in extracting and processing the glyceride oil may also contribute to the metal content of glyceride oil. The metal of the metal-containing glyceride oil may be present in the form of free metal salts, such as metal salts of fatty acids, or in the form of metal-containing compounds or complexes.

Without being bound by any particular theory, one possible reaction mechanism by which the liquid comprising the basic quaternary ammonium salt of the present invention is thought to extract metals is by forming metal-containing complexes. Such complexes may include ionic complexes, complexes resulting from hydrogen bonding, as well as charge-transfer complexes. Another possible means by which metals may be extracted by the basic quaternary ammonium salt treatment is by means of cation exchange with free metal cations to form salts which preferentially partition out of the oil phase. The basicity of the quaternary ammonium salt used in accordance with the present invention may also reduce the proton activity of the oil, which may lead to precipitation of metal-containing compounds or to the formation of quaternary ammonium salts of metal oxide hydrates.

The basic quaternary ammonium salt used in accordance with the present invention has been found to neutralise FFA present in the oil and form quaternary ammonium fatty acid salts. It is possible that these salts formed as a result of the acid-base reaction may also complex metals and contribute to their removal from the oil upon separation of the salt from the treated oil in step (ii). Thus, in some embodiments, where the glyceride oil which is contacted in step (i) comprises FFA, the salt comprising the quaternary ammonium salt which is separated in step (ii) may comprise an anion of a fatty acid.

As described hereinbefore, in some embodiments, the quaternary ammonium cation of the basic quaternary ammonium salt may comprise one or more $C_1$ to $C_8$ alkyl groups substituted by one to three groups selected from: $C_1$ to $C_4$ alkoxy, $C_2$ to $C_8$ alkoxyalkoxy, $C_3$ to $C_6$ cycloalkyl, —OH, —SH, —$CO_2R^e$, and —OC(O)$R^e$, where $R^e$ is $C_1$ to $C_6$ alkyl. Where polar substituents are present, especially —OH which is capable of hydrogen bonding, such groups may enhance the formation of complexes with metal in the oil. Thus, in particularly preferred embodiments of the present invention, the quaternary ammonium cation comprises at least one $C_1$ to $C_8$ alkyl group substituted by one to three —OH groups.

In preferred embodiments, the treated glyceride oil separated in step (ii) contains said metals in a total amount which is less than 50%, preferably less than 75%, of the total amount of said metals in the untreated glyceride oil contacted in step (i).

Analytical methods suitable for determining the concentration of metals in glyceride oil include high-resolution Inductively Coupled Plasma (ICP) Spectrometry analysis, such as ICP-MS (see, for example, J. Agric. Food Chem. 2013, 61, 2276-2283) or ICP-AES; plasma emission spectroscopy (A. J. Dijkstra and D. Meert, J.A.O.C.S. 1982, 59, 199); and X-ray fluorescence analysis. Preferably, ICP-AES analysis is used to determine the metal concentration in connection with the present invention.

In a preferred embodiment of the process of the present invention, at least one further refining step is conducted after treatment of the glyceride oil with the liquid comprising the quaternary ammonium salt. The skilled person is aware of the different refining steps typically used in edible oil processing, including for example refining steps discussed in: "Practical Guide to Vegetable Oil Processing", 2008, Monoj K. Gupta, AOCS Press, as well as in the Edible Oil Processing section of the "AOCS Lipid Library" website lipidlibrary.aocs.org.

The at least one further refining step (iii) may, for instance, be selected from: degumming, bleaching, winterization, depigmentation and deodorisation. Metal contaminants, particularly iron, can cause darkening of glyceride oil during exposure to heat such as in the case of the deodorisation step and so the basic quaternary ammonium salt treatment preferably precedes deodorisation. Thus, in preferred embodiments, the at least one further refining step according to the process of the present invention comprises deodorisation.

In some embodiments, the at least one further refining step (iii) comprises the steps of degumming, bleaching and deodorization. Alternatively, in other embodiments, the at least one further refining step (iii) comprises a deodorisation step and the process does not comprise a step of degumming and/or bleaching. Therefore, in exemplary embodiments, the at least one further refining step comprises the steps of degumming and deodorization, but no bleaching. In other exemplary embodiments, the at least one further refining step comprises the steps of bleaching and deodorization, but no degumming step.

An additional advantage of the treatment with quaternary ammonium salt in accordance with the present invention is that the basic quaternary ammonium salt has also been found to at least partially remove pigments and odiferous compounds which are typically removed in a high temperature (for example, 240° C. to 270° C.) deodorization step during conventional refining processes. Treatment of glyceride oil with the quaternary ammonium salt means that lower temperatures and/or shorter time periods can be used for the deodorization step as part of the overall refining process. This has the advantage of reducing the energy requirements of the refining process.

Degumming typically involves contacting the oil with aqueous phosphoric acid and/or aqueous citric acid to remove both hydratable and non-hydratable phosphatides (NHP). Typically, citric acid or phosphoric acid is added as a 50 wt % aqueous solution. Suitably, the aqueous acid is used in an amount of about 0.02% to about 0.30% of acid by weight of oil, preferably 0.05% to about 0.10% of acid by weight of oil. Suitably, the degumming step is carried out at a temperature of from about 50 to 110° C., preferably 80° C. to 100° C., for example 90° C. The degumming step may suitably last from 5 minutes to 60 minutes, preferably 15 to 45 minutes, more preferably, 20 to 40 minutes, for example 30 minutes. After settling of the mucilage following the acid treatment, the aqueous phase is separated before the degummed oil is typically dried. Drying of the degummed oil suitably takes place at a temperature of from 80 to 110° C. for a suitable time period, for example 20 to 40 minutes, at reduced pressure, for instance, at 2 to 10 kPa (20 to 100 mbar).

As the skilled person is aware, for glyceride oils with low phosphatide content (for example, less than 20 ppm by weight of phosphorus) a dry degumming process may be used in which the phosphoric acid or citric acid is added without significant dilution with water (for example, an 85% acid solution). NHP are converted into phosphatidic acid and a calcium or magnesium bi-phosphate salt which can be removed from the oil in a subsequent bleaching step. For oils rich in phosphatides, particularly NHP, dry degumming is known to be less well suited since excessive amounts of bleaching earth are required.

Bleaching is incorporated into an edible oil refining process to reduce colour bodies, including chlorophyll, residual soap and gums, trace metals and oxidation products. Bleaching typically involves contacting the oil with an amount of bleaching clay or earth, for example from 0.5 to 5 wt. % clay based on the mass of the oil. Bleaching clays or earths are typically composed of one or more of three types of clay minerals: calcium montmorillonite, attapulgite, and sepiolite. Any suitable bleaching clay or earth may be used in accordance with the present invention, including neutral and acid activated clays (e.g. bentonite). The oil is suitably contacted with bleaching clay for 15 to 45 minutes, preferably 20 to 40 minutes before the earth is separated, typically by filtration. The oil is typically contacted with bleaching clay or earth at a temperature of from 80° C. to 125° C., preferably at a temperature of from 90° C. to 110° C. Following an initial period of contact ("wet bleaching") conducted under atmospheric pressure, a second stage of the bleaching process is conducted under reduced pressure ("dry bleaching"), for example at 2 to 3 kPa (20 to 30 mbar).

Conventional glyceride oil refining processes typically include a FFA neutralisation step with a strong base, for example sodium hydroxide or potassium hydroxide (corresponding to a so called "chemical refining" process). Alternatively, deacidification can be achieved by adjusting the deodorisation parameters accordingly to ensure that volatile FFA is removed in that step (a so called "physical refining" process). A disadvantage of a FFA neutralisation step ("chemical refining") is that it is accompanied by unwanted saponification of oil, lowering triglyceride content, whilst soap formation from FFA can lead to substantial neutral oil losses as a result of emulsification. The quaternary ammonium salt treatment forming part of the refining process of the present invention is effective at neutralising FFA in the oil and may entirely replace a conventional neutralisation step used in a chemical refining process. Advantageously, treatment with the quaternary ammonium salt has the benefit that it leads to less or no saponification, in particular when a bicarbonate salt is used, and leads to less or no emulsification of neutral oil. Thus, in preferred embodiments of the present invention, the refining process does not include a neutralisation step with an inorganic base (e.g. sodium hydroxide).

As the skilled person is aware, deodorization corresponds to a stripping process in which an amount of stripping agent is passed through an oil, typically by means of direct injection, at reduced pressure for a period of time so as to vaporize and drive off volatile components, such as FFA, aldehydes, ketones, alcohols, hydrocarbons, tocopherols, sterols, and phytosterols. The stripping agent is preferably steam, although other agents such as nitrogen may be used. The amount of stripping agent suitably used is from about 0.5% to about 3% by weight of oil. Stripping may be carried out in a distillation apparatus for recovering volatile compounds removed with the stripping agent.

The temperature range of deodorization for the refining process according to the present invention is suitably from 160° C. to 270° C. Where reference is made herein to the temperature of the deodorization step, this refers to the temperature of the oil. The pressure range of deodorization is suitably from 0.1 to 0.4 kPa (1 to 4 mbar), preferably 0.2-0.3 kPa (2 to 3 mbar). Suitable time periods for deodorization are typically from 30 to 180 minutes, for example 60 to 120 minutes, or 60 to 90 minutes.

The skilled person is able to determine a suitable length of deodorization by analysing the appearance and composition of the glyceride oil, for instance by determining the p-anisidine value (AnV) of the oil. The p-anisidine value of an oil is a measure of its oxidative state and, more specifically, provides information regarding the level of secondary oxidation products contained in an oil, which are primarily aldehydes such as 2-alkenals and 2,4-dienals. The p-anisidine value (AnV) therefore also gives an indication of the level of oxidation products which are intended to be removed by means of the deodorization step. For instance, satisfactory deodorization may be achieved where, for example, the AnV is less than 10, preferably less than 5, as determined by AOCS Official Method Cd 18-90.

In addition or alternatively, the amount of aldehyde and ketone components of the oil can be determined, which are typically associated with a crude oil's odour, to determine whether sufficient deodorization has taken place. Typical volatile odiferous aldehyde and ketone components of crude or rancid palm oil include: acetaldehyde, benzaldehyde, n-propanal, n-butanal, n-pentanal, n-hexanal, n-octanal, n-nonanal, 2-butenal, 3-methylbutanal, 2-methylbutanal, 2-pentenal, 2-hexenal, 2E,4E-decadienal, 2E,4Z-decadienal, 2-butanone, 2-pentanone, 4-methyl-2-pentanone, 2-heptanone, 2-nonanone. Preferably, each of these components is individually present in a deodorised oil in an amount less than 3 mg/kg of oil, more preferably less than 1 mg/kg of oil, most preferably less than 0.5 mg/kg of oil.

The amount of aldehydes and ketones may be readily determined by chromatographic methods, for instance GC-TOFMS or GCxGC-TOFMS. Alternatively, derivatization of aldehydes and ketones may be used to improve chromatographic analysis. For example, it is known that aldehydes and ketones may be derivatized with 2,4-dinitrophenylhydrazine (DNPH) under acidic conditions. This reagent does not react with carboxylic acids or esters and therefore the analysis is not affected by the presence of such components in a glyceride oil sample. Following derivatization, HPLC-UV analysis can quantify the total amount of aldehydes and ketones which are present in a sample.

Conventional deodorisation temperatures are typically in excess of 220° C., for example 240° C. to 270° C., and deodorisation is typically operated for 60 to 90 minutes. Where lower than conventional temperatures are used for deodorisation as allowed by the process of the present invention, for example 160° C. to 200° C., the time periods for deodorization may be lengthened to ensure sufficient deodorization, yet still involve less energy consumption than a conventional deodorization operated at higher temperature, for example 240° C. to 270° C., for a shorter period.

In preferred embodiments, the same or lower than conventional deodorization time periods are used in combination with the lower than conventional deodorization temperature, yet achieve the same extent of deodorization as a result of the preceding quaternary ammonium salt treatment. In other preferred embodiments, where conventional temperatures are used for the deodorization step included in the refining process of the invention, for example 240° C. to 270° C., the time period for the deodorization may be reduced compared to that which is conventionally used and still achieve a comparable level of deodorization as a result of the preceding quaternary ammonium salt treatment.

The quaternary ammonium salt treatment therefore also has the advantage that it may reduce energy consumption during a subsequent deodorization step. In addition, by reducing either the temperature or time period of exposure to heat during the deodorization step, side reactions that can lead to undesirable organoleptic properties of the oil or formation of unwanted, potentially harmful by-products may also advantageously be reduced.

Where the at least one further refining step according to the process of the present invention comprises deodorisation, the temperature of the deodorization is preferably from 160° C. to 270° C. and more preferably from 160° C. to 240° C. In particularly preferred embodiments, the temperature of the deodorization is from 160° C. to 200° C., more preferably 170° C. to 190° C. Preferably, the time periods over which deodorisation is conducted at these temperatures is from 30 to 150 minutes, more preferably 45 to 120 minutes, most preferably 60 to 90 minutes.

The quaternary ammonium salt treatment according to the process of the present invention may suitably be applied to crude glyceride oil which has not undergone any previous refining steps following oil extraction. Alternatively, the process of the present invention may be applied to glyceride oil which has undergone at least one additional refining step prior to treatment with quaternary ammonium salt. Preferably, the at least one additional refining step is selected from bleaching and/or degumming.

Advantageously, it has been found that the quaternary ammonium salt treatment forming part of the process of the present invention is also capable of at least partially degumming the oil and removing pigments which means that the extent of degumming and bleaching steps can be scaled back, for example, in terms of treatment time or materials. As mentioned above, the quaternary ammonium salt treatment forming part of the process of the present invention obviates a separate FFA neutralisation step used in a chemical refining process. Meanwhile, the quaternary ammonium salt treatment forming part of the process of the present invention may also be capable of reducing energy consumption in a deodorization step.

The basic quaternary ammonium salt treatment used in accordance with the present invention is intended to obviate the use of ion exchange resins and ultrafiltration membranes and the like for removing contaminants which can contribute significantly to the materials costs associated with glyceride oil refining. Thus, in preferred embodiments, the refining processes described herein do not comprise treatment of the glyceride oil with ion exchange resins or ultrafiltration membranes.

In some embodiments, the quaternary ammonium salt used in contact step (i) may be regenerated from the salt comprising the quaternary ammonium cation separated in step (ii) (where these salts are different) by means of a regeneration process in order to recycle the quaternary ammonium salt to the refining process of the invention, if desired. For instance, a regeneration process may comprise anion or cation exchange steps to obtain a quaternary ammonium salt comprising the desired basic anion as described hereinbefore.

In an embodiment, the regeneration process for regenerating choline bicarbonate from a choline fatty acid salt comprises the steps of:

(a) contacting the choline fatty acid salt with carbonic acid; and (b) separating choline bicarbonate from FFA formed in step (a).

Preferably, step (a) is performed by contacting an aqueous solution comprising the choline fatty acid salt with $CO_2$ (e.g. by bubbling $CO_2$ through the aqueous solution).

The present invention also provides a use of contacting a glyceride oil with a basic quaternary ammonium salt as described hereinbefore for reducing the metal content of a metal-containing glyceride oil.

The basic quaternary ammonium salt may be used in the form of a liquid comprising the basic quaternary ammonium salt as described hereinbefore.

Preferably, the basic quaternary ammonium salt is used to treat the metal-containing glyceride oil before the glyceride oil is subjected to a heating step as part of its refining. The heating step may, for instance, correspond to heating the oil to temperatures in excess of, for example, 150° C., 200° C. or even 250° C. The heating step may therefore form part of a deodorization step. As discussed above, the presence of iron can have a negative impact on the oil's organoleptic properties if it is present in sufficient quantities during exposure of the oil to heat, such as in a deodorization step. Therefore, it is beneficial to remove a significant amount of iron and other pro-oxidant metals by way of a treatment with the basic quaternary ammonium salt prior to the heating step.

Preferred embodiments of other aspects of the invention relating to the nature of the anion and cation of the basic quaternary ammonium salt, as well as the nature of the glyceride oil, equally apply to this aspect of the invention. For instance, it is most preferred that the glyceride oil is palm oil and that the basic quaternary ammonium salt is choline bicarbonate.

Embodiments of the invention described hereinbefore may be combined with any other compatible embodiments to form further embodiments of the invention.

The present invention will now be illustrated by way of the following examples.

EXAMPLES

General Method for Determination of Acid Value (Mg KOH/g of Oil) and FFA (Wt. %) Content of Palm Oil.

To a beaker containing 60 ml of isopropanol was added 0.5 ml of phenolphthalein. This mixture was heated until boiling and 0.02 M potassium hydroxide in isopropanol was added until a faint pink colour persisted for approximately 10 s.

To a glass vial was added 0.200 g of the palm oil sample which was subsequently dissolved in 50 ml of the above hot isopropanol solution. The resulting solution was titrated whilst stirring with 0.02 M potassium hydroxide solution using a 25 ml burette graduated in 0.1 ml to the end point of the phenolphthalein indicator i.e until the pink colour persisted for at least 30 s.

The Acid Value (mg KOH/g of oil) was subsequently calculated using the formula:

$$56.1 \times N \times V/m$$

where:

56.1 is the molecular weight (g/mol) of potassium hydroxide;

V is the volume (ml) of potassium hydroxide solution used;

N is the normality (mol/l) of the potassium hydroxide solution; and m is the mass (g) of the palm oil sample.

Once the Acid Value has been determined, the FFA content may be derived. The FFA content for the purposes of the present disclosure is defined as a mass percentage while assuming the FFA to be an equal mixture of palmitic acid (molecular weight 256 g/mol) and oleic acid (molecular weight 282 g/mol), giving an average molecular weight of 269 g/mol. Oil with a FFA content of 1 wt. % contains 0.01 g of oleic/palmitic acid per 1 g of oil, which amount of oleic/palmitic acid corresponds to $3.171 \times 10^{-5}$ mol. The amount of KOH required to neutralise this amount of oleic/palmitic acid (i.e. the Acid Value—AV) is calculated to be 2.086 mg of KOH/g of oil ($3.171 \times 10^{-5} \times 56.1$).

Calculation of FFA content (wt. %) therefore has the following formula:

$$\text{Wt. \% FFA} = \text{Acid Value} \times 0.479$$

General Method for Physical Refining of Palm Oil

The general method for a physical refining process involving degumming, bleaching, deodorisation using industry standard conditions are set out in Table 1 below.

TABLE 1

| Refining Stage | Process Details |
|---|---|
| Degumming | Oil is heated to 60° C. and 0.06% (mass of acid per mass of oil) of citric acid (50% aqueous solution) is added to the heated oil drop-wise and reacted for 30 min. Mucilage is allowed to settle before the aqueous phase is separated. |
| Desiccation | Degummed oil is dried at 95° C. for 30 min at 10 kPa (100 mbar). |
| Bleaching | Oil is heated under atmospheric pressure and constant stirring to 95° C. Oil is then treated with 1% bleaching clay (Tonsil Supreme 118 FF) and stirred for 5 min ("wet bleaching"). Subsequently, the oil is stirred at a reduced pressure of 2 to 3 kPa (20 to 30 mbar) at 95° C. for 15 min ("dry bleaching"). The mixture of oil and bleaching clay is separated by vacuum filtration with a suction-filter and unbleached filter paper MN620. |
| Deodorization | Oil is placed in a flask and the apparatus evacuated to a pressure of 0.1 kPa (1 mbar) before being heated to a target temperature (260° C.) in a heating mantle. Water is introduced using a microliter pump when the oil temperature reaches 160° C. and at a rate of 1% by weight of water/h. The deodorization |

TABLE 1-continued

| Refining Stage | Process Details |
|---|---|
| | time starts when the target temperature is reached. After deodorization time (120 min) the oil is cooled by switching off the heating mantle and the water feed is shut down when the oil temperature reaches 160° C. When the deodorized oil cools down to 80° C., the pressure valve is opened to return the apparatus to atmospheric pressure. |

Where reference is made herein to the use of the refining stages according to Table 1 as part of an oil refining treatment, experiments were performed using laboratory scale equipment (for example, a three-necked flask with stirring device, temperature measurement and vacuum connection). With regard to the deodorization according to Table 1, as well as the two-stage deodorization reported in examples below, this step was carried out with equipment including Deso-pistons allowing for water addition for steam stripping, a vacuum generator, a condenser, a thermometer and a heating mantle.

General Method for Determination of Metal Content of Crude and Treated Oils

The metal content of the oils was determined by ICP-AES analysis for oils that had not been subjected to a refining stage as outlined in table 1 and by AAS analysis (ASU L 00.00-19/1) according to standard method DIN EN ISO 11885 for oils that had been subjected to one or more refining stages.

Example 1

Metal Removal by Quaternary Ammonium Salt Treatment of Crude Palm Oil

A sample of 1 kg of crude palm oil (CPO) having a measured FFA content of 7.48 wt. % was heated to 50° C. in a thermostatically controlled water bath. The homogenized CPO was then added to a 2 l stirred tank reactor in which the reactor temperature was maintained at 50° C. by means of circulating heated oil. A stoichiometric amount of choline bicarbonate (80 wt. % in H2O supplied by Sigma-Aldrich UK) relative to the FFA content of the CPO was then introduced to the reaction vessel at a rate of 1-2 ml per minute. The mixture was stirred at 500 min-1 using a mechanical overhead stirrer for 1 h. Thereafter, the mixture was centrifuged at 4000 min-1 for 3 minutes to separate a phase comprising quaternary ammonium-FFA salts and a treated CPO phase. The separated oil phase was analysed and found to contain 0.18 wt. % FFA and 0.11 wt. % water. Metal concentration of the CPO and the treated oil phase were determined. Results are provided in Table 2 below.

TABLE 2

| | FFA | Water | Metal content mg/kg | | | |
|---|---|---|---|---|---|---|
| Palm Oil | wt. % | wt. % | Fe | Ni | Cu | Cr |
| CPO | 7.48 | 0.18 | 3665 | 37 | 138 | 84 |
| Example 1 | 0.18 | 0.11 | 1885 | 2 | 4 | 11 |

Example 2

Metal Removal by Quaternary Ammonium Salt Treatment of Crude Palm Oil

Example 1 was repeated with a different crude palm oil (CPO) having a measured FFA content of 3.21 wt. %. The separated oil phase was analysed and found to contain 0.1 wt. % FFA and 0.08 wt. % water. Metal concentration of the CPO and the treated oil phase were determined. Results are provided in Table 3.

TABLE 3

| | FFA | Water | Metal content mg/kg | | | |
|---|---|---|---|---|---|---|
| Palm Oil | wt. % | wt. % | Fe | Ni | Cu | Cr |
| CPO | 3.21 | 0.12 | 1885 | 0.9 | 2.1 | 1.4 |
| Example 1 | 0.09 | 0.08 | 105 | 0.03 | 0.05 | 0.06 |

The results for Examples 1 and 2 shown in Tables 2 and 3 demonstrate that the basic quaternary ammonium salt treatment according to the present invention is capable of significantly reducing the total metal concentration of the oil. Removal of metals from the oil is also consistent with the degumming effect illustrated in later examples.

Iron, a pro-oxidant metal which has a significant impact on the colour of the oil after exposure to heat, for instance in the deodorization step, is one of the most prevalent metal contaminants in the CPO tested, as illustrated in Tables 2 and 3. Treatment with the quaternary basic ammonium salt removes significant quantities of iron whilst other common metal contaminants, including nickel, copper and chromium, may be reduced to sub-ppm levels.

Example 3

Conventional Physical Refining of Crude Palm Oil

A sample of CPO having a measured FFA content of 3.97 wt. % was refined by a conventional physical refining process involving degumming, bleaching and deodorisation using the conditions set out in Table 1 above. Quality parameters were determined before and after refining of the oil. Results are provided in Table 4 below alongside the measuring methods used. Sensoric tests of the refined oil were also undertaken at KIN GmbH Lebensmittel Institute with a panel of four examiners judging color, taste, appearance and smell according to method BVL L 00.90-6 (published in the online database managed by Beuth-Verlag: "Official Collection of Testing Methods according to § 64 LFGB, § 35 of the Draft Tobacco Regulation and pursuant to § 28b of the Genetic Engineering Act"). Examiners judge each parameter on a scale of from 1 to 5 (1/2=Not for consumption, 3=Sufficient, 4=Good, 5=Excellent) and mean and median values of the judgement are presented as final results for each parameter. Typically, for an oil sample to be considered commercially acceptable, values for each parameter are required to be either 4 or 5. Results are provided in Table 4 below.

Example 4

Quaternary Ammonium Salt Treatment of Crude Palm Oil Followed by Tailored Deodorization A sample of 4 kg of the same CPO as used in Example 3 was heated to 50° C. in a thermostatically controlled water bath before being added to a stirred tank reactor in which the reactor temperature was maintained at 50° C. by means of circulating heated oil. A stoichiometric amount of choline bicarbonate (80 wt. % in water supplied by Sigma-Aldrich UK) relative to the FFA content of the CPO was then introduced to the reaction vessel at a rate of 1-2 ml per minute. The mixture was stirred at 500 $min^{-1}$ using a mechanical overhead stirrer for 1 h. Thereafter, the mixture was centrifuged at 4000 $min^{-1}$ for 3 minutes to separate a phase comprising quaternary ammonium-FFA salts and a phase of treated palm oil. The separated oil phase was titrated and found to contain 0.05 wt. % FFA.

The treated palm oil was then subjected to a two stage deodorization, the first stage at a temperature of 240° C. for 10 minutes and the second at a temperature of 180° C. for 120 minutes (lower than a conventional deodorization temperature) and both stages operating at 0.2 to 0.3 kPa (2 to 3 mbar). No degumming or bleaching steps were undertaken. Quality parameters were determined for the treated palm oil before and after deodorization. Results are provided in Table 4 below alongside the measuring methods used. Sensoric tests of the quaternary ammonium salt treated and deodorized oil were also undertaken at KIN GmbH Lebensmittel Institute as described for Example 3. Results are provided in Table 5 below.

Example 5

Quaternary Ammonium Salt Treatment of Crude Palm Oil Followed by Tailored Deodorization The two stage deodorization of example 4 was repeated, but the second deodorization stage was carried out with a temperature of 200° C. instead of 180° C.

Example 6

Quaternary Ammonium Salt Treatment of Crude Palm Oil Followed by Tailored Physical Refining A sample of the quaternary ammonium salt treated palm oil from Example 4 was subjected to degumming and bleaching steps as set out in Table 1 above followed by the two stage deodorization of example 4.

TABLE 4

| Measurement | Unit | Method | CPO | Ex. 3 | Ex. 4[1] | Ex. 4[2] | Ex. 5 | Ex. 6 |
|---|---|---|---|---|---|---|---|---|
| Acid Value | mg KOH/g Oil | DGF-C-V 2 (06) | 8.3 | 0.0 | 0.1 | 0.1 | 0.0 | 0.1 |
| FFA content | wt. % | | 3.97 | 0.0 | 0.05 | 0.05 | 0.0 | 0.05 |
| Phosphorus Value | mg/kg | DIN EN 14107 | 8.1 | <0.5 | 2.1 | 1.3 | 1.6 | <0.5 |
| Diglyceride content | wt. % | DGF-C-III 3c (10) | 6.4 | — | 5.7 | — | — | — |
| Monoglyceride content | wt. % | DGF-C-III 3c (10) | 0.4 | — | 0.4 | — | — | — |
| Color | — | Lovibond, AOCS RY, 1" | — | 1.0 | — | 1.5 | 1.5 | 0.2 |
| Chromium | mg/kg | | 0.55 | 0.06 | 0.04 | <0.02 | 0.18 | 0.35 |
| Iron | mg/kg | | 24.44 | 6.71 | 9.21 | 3.36 | 5.89 | 19.1 |
| Cobalt | mg/kg | | — | <0.02 | <0.02 | <0.02 | <0.02 | 0.03 |
| Nickel | mg/kg | | 0.76 | 0.15 | 0.18 | 0.15 | 0.38 | 0.53 |
| Copper | mg/kg | | 0.63 | 0.28 | 0.46 | <0.02 | 0.05 | 0.40 |

[1]= Quaternary ammonium salt treated oil prior to deodorization;
[2]= Quaternary ammonium salt treated oil after deodorization.

TABLE 5

| | Color | Appearance | Smell | Taste | Overall |
|---|---|---|---|---|---|
| Example 3 (mean/median values) | 4.8/5 | 4.8/5 | 4.3/4 | 4.3/4 | Good to Excellent |
| Example 4 (mean/median values) | 3.3/3 | 3.5/5 | 3.3/3 | 2.8/2.5 | Sufficient |
| Example 5 (mean/median values) | 3.5/3.5 | 3.5/3.5 | 2.0/2.0 | 3.0/3.0 | Not for consumption |
| Example 6 (mean/median values) | 5.0/5.0 | 5.0/5.0 | 4.5/4.5 | 4.8/5.0 | Excellent |

The results in Table 4 illustrate the advantages of the quaternary ammonium salt treatment of the present invention.

The results for Example 4 (quaternary ammonium salt treated oil) in comparison with CPO demonstrate that the quaternary ammonium salt treatment removes a significant amount of FFA whilst having minimal impact on mono- and di-glyceride content of the oil. The results for Examples 4, 5 and 6 also demonstrate that when the quaternary ammonium salt treatment is followed by deodorization, substantially all of the FFA in the oil is removed.

In Example 6 the quaternary ammonium salt treatment was followed by conventional degumming, bleaching and deodorization steps. In comparison, the conventional process of Example 3 differs by the absence of the quaternary ammonium salt treatment. Surprisingly, the phosphorus level observed for the oil after the quaternary ammonium salt treatment of Example 4 is significantly lower than that of crude palm oil (2.1 mg/kg compared to 8.1 mg/kg). This demonstrates that the quaternary ammonium salt treatment contributes to degumming of the oil. In Examples 4 and 5, the quaternary ammonium salt treatment is followed only by deodorization, without any intervening degumming or bleaching steps. Although the quaternary ammonium salt treatment alone is not as effective as a conventional degumming step when a comparison is made between the phosphorus values of the oils of Examples 3, 4 and 5 (<0.5 mg/kg, 1.3 and 1.6 mg/kg respectively), the quaternary ammonium salt treatment alone is nevertheless capable of producing a satisfactory level of degumming. A desirable level of degumming in the case of refined palm oil corresponds to a reduction in phosphorus value to 5 ppm or below. Therefore, values of 1.3 and 1.6 mg/kg are well inside this quality parameter. This demonstrates that the quaternary ammonium salt treatment is capable of replacing a degumming step. Since degumming may also be associated with metal removal, these results also support the metal-removing effect of the basic quaternary ammonium salt treatment.

The results in Table 5 indicate that when the quaternary ammonium salt treatment is integrated into a physical refining process, including degumming and bleaching, yet with a lower temperature deodorization stage (Example 5) then results range from sufficient to excellent. The first higher temperature stage of the two-stage deodorization is intended to perform the majority of oil depigmentation. However, superior sensoric results were surprisingly obtained when the temperature of the second stage of the two-stage deodorization was lowered still further to 180° C. following quaternary ammonium salt treatment, degumming and bleaching (Example 6). The quaternary ammonium salt treatment of the invention thus offers the possibility of lowering deodorization temperatures to reduce the energy expenditure of a glyceride oil refining process whilst removing metal contaminants and still providing a product with adequate olfactory qualities.

Where the quaternary ammonium salt treatment also effectively replaces degumming and bleaching steps, sensoric qualities of the oil may not be satisfactory unless a conventional prolonged high-temperature deodorization step is incorporated, as suggested by the results for Examples 4 and 5 in Table 5.

The invention claimed is:

1. A process for removing metal from a metal-containing glyceride oil comprising the steps of:

(i) contacting a glyceride oil, comprising at least one metal from the group consisting of chromium, manganese, iron, cobalt, nickel and copper, with a liquid comprising a basic quaternary ammonium salt to form a treated glyceride oil; wherein said glyceride oil contains said metals in a total amount of from 10 mg/kg to 10,000 mg/kg, and wherein the basic quaternary ammonium salt comprises a basic anion selected from hydroxide, alkoxide, alkylcarbonate, hydrogen carbonate, carbonate, serinate, prolinate, histidinate, threoninate, valinate, asparaginate, taurinate and lysinate; and a quaternary ammonium cation; and (ii) separating the treated glyceride oil from a salt comprising the quaternary ammonium cation after contacting the glyceride oil with the quaternary ammonium salt, providing a treated glyceride oil containing a reduced amount of said metals compared to the glyceride oil contacted in step (i).

2. The process of claim 1, comprising the additional step of:

(iii) subjecting the treated glyceride oil after the separation step to at least one further refining step.

3. The process of claim 2, wherein the at least one further refining step comprises a deodorisation step.

4. The process of claim 3, wherein the deodorisation step involves steam stripping conducted at a temperature of from 160° C. to 270° C.

5. The process of claim 3, wherein the deodorisation step involves steam stripping conducted at a temperature of from 160° C. to 240° C.

6. The process of claim 2, wherein the process further comprises at least one additional refining step of the glyceride oil conducted prior to the treatment with the basic quaternary ammonium salt in step (i), the at least one additional refining step being selected from bleaching and degumming.

7. The process of claim 2, wherein the at least one further refining step (iii) comprises a deodorisation step and the process does not comprise a step of degumming or bleaching.

8. The process of claim 1, wherein the total amount of said metals in the glyceride oil prior to contacting in step (i) is 50 mg/kg to 5,000 mg/kg.

9. The process of claim 1, wherein the treated glyceride oil separated in step (ii) contains said metals in a total amount which is less than 50% of the total amount of said metals in the untreated glyceride oil contacted in step (i).

10. The process of claim 1, wherein the treated glyceride oil separated in step (ii) contains said metals in a total amount which is less than 75% of the total amount of said metals in the untreated glyceride oil contacted in step (i).

11. The process of claim 1, wherein the salt separated in step (ii) comprises an anion of a free fatty acid.

12. The process of claim 1, wherein the contacting step is conducted at a temperature of less than 80° C.

13. The process of claim 1, wherein the contacting step is conducted at a temperature of from 35 to 55° C.

14. The process of claim 1, wherein the quaternary ammonium cation is selected from:

$[N(R^a)(R^b)(R^c)(R^d)]^+$, wherein $R^a$, $R^b$, $R^c$ and $R^d$ are each independently selected from $C_1$ to $C_8$ alkyl, wherein one or more of $R^a$, $R^b$, $R^c$ or $R^d$ may optionally be substituted at carbon atoms that are not bonded to the nitrogen atom by one to three groups selected from: $C_1$ to $C_4$ alkoxy, $C_2$ to $C_8$ alkoxyalkoxy, $C_3$ to $C_6$ cycloalkyl, OH, SH, $CO_2R^e$, and $OC(O)R^e$, where $R^e$ is $C_1$ to $C_6$ alkyl.

15. The process of claim 14, wherein $R^a$, $R^b$, $R^c$ and $R^d$ are each independently selected from $C_1$ to $C_4$ alkyl, wherein at least one of $R^a$, $R^b$, $R^c$ or $R^d$ is substituted each by a single —OH group.

16. The process of claim 14, wherein the quaternary ammonium cation is choline: $(CH_3)_3N^+CH_2CH_2OH$.

17. The process of claim 1, wherein the basic anion is selected from alkylcarbonate, hydrogen carbonate and carbonate.

18. The process of claim 17, wherein the quaternary ammonium salt contacted in step (i) is choline bicarbonate: $(CH_3)_3N^+CH_2CH_2OH\ HOCOO^-$.

19. The process of claim 1, wherein the basic anion is selected from hydroxide and alkoxide.

20. The process of claim 19, wherein the basic quaternary ammonium salt contacted in step (i) is choline hydroxide: $(CH_3)_3N^+CH_2CH_2OH\ OH^-$.

21. The process of claim 1, wherein the liquid comprising the basic quaternary ammonium salt comprises a solvent and the concentration of quaternary ammonium salt in the liquid is 15 wt. % to 90 wt. %.

22. The process of claim 21, wherein the solvent is an aqueous solvent.

23. The process of claim 18, wherein the liquid comprising the basic quaternary ammonium salt comprises an aqueous solvent and wherein the concentration of quaternary ammonium salt in the liquid is 50 wt. % to 90 wt. %.

24. The process of claim 20, wherein the liquid comprising the basic quaternary ammonium salt comprises an aqueous solvent and wherein the concentration of quaternary ammonium salt in the liquid is 15 wt. % to 60 wt. %.

25. The process of claim 1, wherein the glyceride oil is a vegetable oil.

26. The process of claim 25, wherein the vegetable oil is selected from coconut oil, corn oil, cottonseed oil, groundnut oil, olive oil, palm oil, rapeseed oil, rice bran oil, safflower oil, soybean oil, sunflower oil, and mixtures thereof.

27. The process of claim 1, wherein the glyceride oil is palm oil.

28. A method for reducing the metal content of a metal-containing glyceride oil, comprising contacting a glyceride oil with a basic quaternary ammonium salt, said basic quaternary ammonium salt comprising a basic anion selected from hydroxide, alkoxide, alkylcarbonate, hydrogen carbonate, carbonate, serinate, prolinate, histidinate, threoninate, valinate, asparaginate, taurinate and lysinate; and a quaternary ammonium cation.

29. The method of claim 28, wherein the glyceride oil is a vegetable oil selected from coconut oil, corn oil, cottonseed oil, groundnut oil, olive oil, palm oil, rapeseed oil, rice bran oil, safflower oil, soybean oil, sunflower oil, and mixtures thereof.

30. The method of claim 28, wherein the glyceride oil is palm oil.

31. The method of claim 28, wherein the quaternary ammonium cation is selected from:

$[N(R^a)(R^b)(R^c)(R^d)]^+$, wherein $R^a$, $R^b$, $R^c$ and $R^d$ are each independently selected from $C_1$ to $C_8$ alkyl, wherein one or more of $R^a$, $R^b$, $R^c$ or $R^d$ may optionally be substituted at carbon atoms that are not bonded to the nitrogen atom by one to three groups selected from: $C_1$ to $C_4$ alkoxy, $C_2$ to $C_8$ alkoxyalkoxy, $C_3$ to $C_6$ cycloalkyl, OH, SH, $CO_2R^e$, and $OC(O)R^e$, where $R^e$ is $C_1$ to $C_6$ alkyl.

32. The method of claim 31, wherein $R^a$, $R^b$, $R^c$ and $R^d$ are each independently selected from $C_1$ to $C_4$ alkyl, wherein at least one of $R^a$, $R^b$, $R^c$ or $R^d$ is substituted each by a single —OH group.

33. The method of claim 31, wherein the quaternary ammonium cation is choline: $(CH_3)_3N^+CH_2CH_2OH$.

34. The method of claim 28, wherein the quaternary ammonium salt is choline bicarbonate: $(CH_3)_3N^+CH_2CH_2OH\ HOCOO^-$.

35. The method of claim 28, wherein the basic quaternary ammonium salt is choline hydroxide: $(CH_3)_3N^+CH_2CH_2OH\ OH^-$.

* * * * *